US007256743B2

(12) United States Patent
Korva

(10) Patent No.: US 7,256,743 B2
(45) Date of Patent: Aug. 14, 2007

(54) INTERNAL MULTIBAND ANTENNA

(75) Inventor: Heikki Korva, Tupos (FI)

(73) Assignee: Pulse Finland Oy, Kempele (FI)

( * ) Notice: Subject to any disclaimer, the term of this patent is extended or adjusted under 35 U.S.C. 154(b) by 0 days.

(21) Appl. No.: 11/279,664

(22) Filed: Apr. 13, 2006

(65) Prior Publication Data

US 2006/0170600 A1 Aug. 3, 2006

Related U.S. Application Data

(63) Continuation of application No. PCT/FI04/00543, filed on Sep. 17, 2004.

(30) Foreign Application Priority Data

Oct. 20, 2003 (FI) ..... 20031529

(51) Int. Cl.
*H01Q 1/24* (2006.01)

(52) U.S. Cl. ..... 343/702; 343/846

(58) Field of Classification Search ..... 343/700 MS, 343/702, 815, 829, 846
See application file for complete search history.

(56) References Cited

U.S. PATENT DOCUMENTS 6,348,892 B1 * 2/2002 Annamaa et al. .... 343/700 MS (Continued)

FOREIGN PATENT DOCUMENTS

EP 1294049 3/2003

(Continued)

OTHER PUBLICATIONS

Ciais, Pascal et al., "Design of an Internal Quad-Band Antenna for Mobile Phones," IEEE Microwave and Wireless Components Letters, vol. 14, No. 4, pp. 148-150, Apr. 2004.

(Continued)

*Primary Examiner*—Tho Phan
(74) *Attorney, Agent, or Firm*—Darby & Darby

(57) ABSTRACT

The invention relates to an internal multiband antenna intended for small-sized radio devices, and a radio device with such an antenna. The basic structure of the antenna is a two-band PIFA. A parasitic element (230) is added to it inside the outline of the radiating plane (220) of the PIFA, e.g. in the space (229) between the conductor branches (221, 222) of the radiating plane. The parasitic element extends close to the feeding point (FP) of the antenna, from which place it is connected to the ground plane of the antenna with its own short-circuit conductor (235). The structure is dimensioned so that the resonance frequency based on the parasitic element comes close to the one resonance frequency of the PIFA, thus widening the corresponding operating band, or a separate third operating band is formed for the antenna with the parasitic element. Because the parasitic element is located in the central area of the radiating plane and not in its peripheral area, the radio device user's hand does not significantly impair the matching of the antenna on an operating band which has been formed by the parasitic element. In addition, when the resonance frequency based on the parasitic element is on the upper operating band, the matching of the antenna also improves on the lower operating band.

9 Claims, 3 Drawing Sheets

U.S. PATENT DOCUMENTS

| | | | | |
|---|---|---|---|---|
| 6,639,560 | B1 * | 10/2003 | Kadambi et al. | 343/700 MS |
| 6,922,171 | B2 * | 7/2005 | Annamaa et al. | 343/700 MS |
| 2002/0070902 | A1 | 6/2002 | Johnson et al. | |
| 2004/0041733 | A1 * | 3/2004 | Milosavljevic | 343/700 MS |
| 2004/0080457 | A1 * | 4/2004 | Guo et al. | 343/700 MS |
| 2004/0137950 | A1 * | 7/2004 | Bolin et al. | 455/562.1 |

FOREIGN PATENT DOCUMENTS

| | | |
|---|---|---|
| EP | 1414106 | 4/2004 |
| SE | 518988 | 12/2002 |
| WO | WO-02/078123 | 10/2002 |
| WO | WO-2004/038856 | 5/2004 |

OTHER PUBLICATIONS

International Search Report from PCT International Application No. PCT/FI2004/00543, issued Dec. 20, 2004.
IPRP from PCT International Application No. PCT/FI2004/000543, issued Apr. 24,2006.
Search Report from Finnish Application No. FI 20031529, issued May 25, 2004.

* cited by examiner

INTERNAL MULTIBAND ANTENNA

CROSS REFERENCE TO PRIOR APPLICATION

This application is a continuation of International Patent Application Serial No. PCT/FI2004/000543, filed Sep. 17, 2004, which claims priority of Finnish Application No. 20031529, filed Oct. 20, 2003, both of which are incorporated by reference herein. PCT/FI2004/000543 published in English on Apr. 28, 2005 as WO 2005/038981 A1.

The invention relates to an internal multiband antenna intended for small-sized radio devices. The invention also relates to a radio device with an antenna according to the invention.

BACKGROUND OF THE INVENTION

Models that operate in two or more systems using different frequency ranges, such as different GSM systems (Global System for Mobile telecommunications) have become increasingly common in mobile stations. The basic condition for the operation of the mobile station is that the radiation and reception properties of its antenna are satisfactory on the frequency bands of all the systems in use. Without any limit on size, it is relatively easy to make a high-quality multiband antenna. However, in mobile stations, especially mobile phones, the antenna must be small when it is placed inside the covering of the device for comfort of use. This increases the requirements of antenna design.

In practice, an antenna of sufficiently high quality that can be placed inside a small device can be most easily implemented as a planar structure: The antenna includes a radiating plane and a ground plane parallel with it. In order to facilitate matching, the radiating plane and the ground plane are usually connected to each other at a suitable point by a short-circuit conductor, whereby the resulting structure is of the PIFA (planar inverted F-antenna) type. The number of operating bands can be increased to two by dividing the radiating plane by means of a non-conductive slot into two branches of different lengths as viewed from the short-circuit point, in a way that the resonance frequencies of the antenna parts that correspond to the branches fall in the ranges of the desired frequency bands. However, in that case the adaptation of the antenna can become a problem. It is especially difficult to make the upper operating band of the antenna sufficiently wide when it is wanted to cover the bands used by two systems. One solution is to increase the number of antenna elements. An electromagnetically coupled, i.e. parasitic planar element is placed close to the primary radiating plane. The resonance frequency of the parasitic element is arranged e.g. close to the other resonance frequency of a two-band PIFA so that a uniform, relatively wide operating band is formed.

FIG. 1 shows such a known internal multiband antenna. In the figure there is the circuit board 101 of a radio device, which circuit board has a conductive upper surface. This conductive surface functions as the ground plane 110 of the planar antenna. At the one end of the circuit board there is a radiating plane 120 with a roughly rectangular outline, the plane being supported above the ground plane with a dielectric frame 150. From the edge of the radiating plane, close to a corner, starts the first short-circuit conductor 125 that connects the radiating plane to the ground plane, and the feed conductor 126 of the whole antenna. From the feed conductor, there is a ground isolated lead-through to the antenna port AP on the lower surface of the circuit board

101. The radiating plane 120 has been shaped by means of a slot 129 therein in a way that the plane is divided into two conductor branches of clearly different lengths as viewed from its short-circuit point, the PIFA thus being dual-band. The lower operating band is based on the first, longer conductor branch 121 and the upper operating band on another, shorter conductor branch 122. The antenna structure also includes a radiating parasitic element 130. This is a planar conductor piece on the same geometric plane with the radiating plane 120. The parasitic element is located adjacent to the radiating plane on its long side next to the first portion of the first conductor branch mentioned above. One end of the parasitic element is connected to the ground with the second short-circuit conductor 135, which is relatively close to the feed conductor 126. In that case, the electromagnetic coupling between the parasitic element 130 and the radiating plane 120 is obtained to be strong enough to make the parasitic element function as a radiator. Together with the surrounding structure, the parasitic element forms a resonator which has a natural frequency on the band of the PCS1900 system (Personal Communication Service), for example. If the natural frequencies of the PIFA have then been arranged on the bands of the GSM900 and GSM1800 systems, for example, the result is an antenna that operates in three systems.

The structure according to FIG. 1 has the drawback that the parasitic element is relatively sensitive to external conductive materials. Therefore, the mobile phone user's hand can significantly impair the band properties of the antenna. In addition, the matching of the antenna on the lower operating band leaves room for improvement.

SUMMARY OF THE INVENTION

The object of the invention is to reduce the above mentioned drawbacks of the prior art. The antenna according to the invention is characterized in what is set forth in the independent claim 1. The radio device according to the invention is characterized in what is set forth in the independent claim 9. Some preferred embodiments of the invention are set forth in the other claims.

The basic idea of the invention is the following: The basic structure of the antenna is a two-band PIFA. A parasitic element is added to it inside the outline of the radiating plane of the PIFA, e.g. in the space between the conductor branches of the radiating plane. The parasitic element extends close to the feed point of the antenna, from which place it is connected to the ground plane of the antenna with its own short-circuit conductor. The structure is dimensioned so that the resonance frequency based on the parasitic element comes close to the one resonance frequency of the PIFA, thus widening the corresponding operating band, or a separate third operating band is formed for the antenna with the parasitic element.

The invention has the advantage that external elements, especially the radio device user's hand, do not significantly impair the antenna matching on the operating band which has partially been formed with the parasitic element. This is due to the fact that the parasitic element is located in the central area of the whole radiator plane, and not in its peripheral area. For the same reason the battery of the radio device does not significantly impair the efficiency of the antenna on the band of the parasitic element, which impairment is common in prior art devices. In addition, the invention further has the advantage that when the resonance frequency based on the parasitic element is on the upper operating band, the antenna matching is also improved on the lower operating band compared to the prior art. Furthermore, the invention has the advantage that an antenna operating on certain frequencies can be made smaller than a corresponding prior art antenna. This is due to the fact that the coupling between the parasitic element and the conductor branch corresponding to the lower operating band of the PIFA has a strongly increasing effect on the electric lengths of the elements.

BRIEF DESCRIPTION OF THE DRAWINGS

In the following, the invention will be described in more detail. Reference will be made to the accompanying drawings, in which.

DETAILED DESCRIPTION OF THE INVENTION

Figure 1:
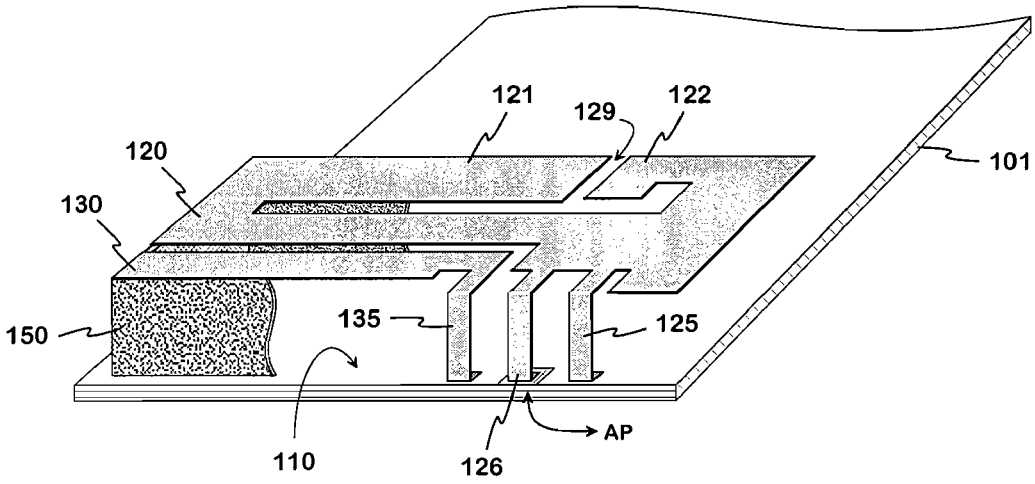
Fig. 1 PRIOR ART
FIG. 1 shows an example of a prior art internal multiband antenna.

FIG. 1 was dealt with above in connection with the description of the prior art.

Figure 2:
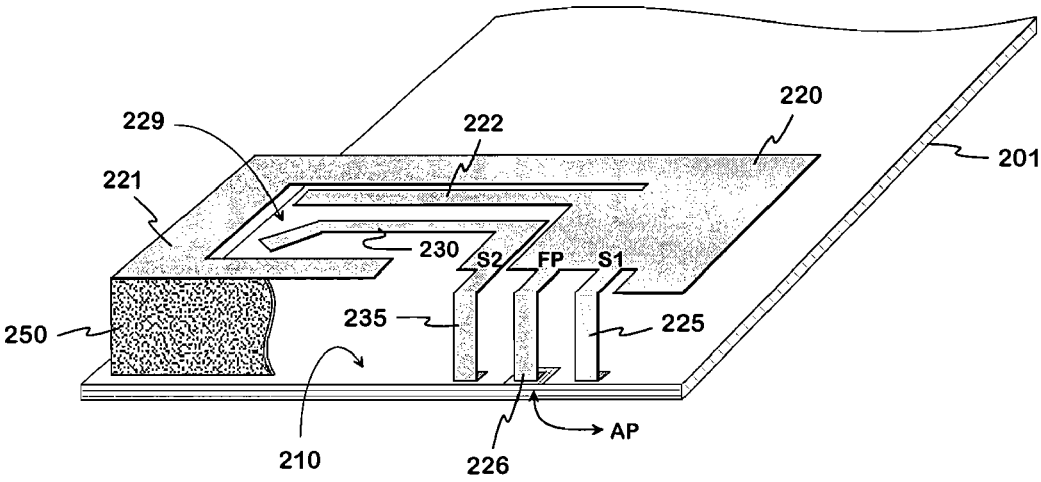
FIG. 2 shows an example of an internal multiband antenna according to the invention.

FIG. 2 shows an example of an internal multiband antenna according to the invention. In the figure there is a circuit board 201 of a radio device with a conductive upper surface, which operates as the ground plane 210 of the antenna. At the one end of the circuit board, above the ground plane, there is the radiating plane 220 of the antenna, which has a rectangular outline. The first short-circuit conductor 225, connecting the radiating plane to the ground plane, starts from the edge of the radiating plane, one of its long sides. Its connecting point in the radiating plane is called the first short-circuit point S1. Close to the first short-circuit point in the radiating plane, there is the feed point FP of the whole antenna, from which the feed conductor 226 of the antenna starts. From the feed conductor there is a ground-isolated lead-through to the antenna port AP on the lower surface of the circuit board 201. So, the radiating plane 220 together with the ground plane forms an antenna of the PIFA type. This is a dual-band antenna, because there are two conductor branches of different lengths in the radiating plane, as viewed from the first short-circuit point S1. The lower operating band is based on the first conductor branch 221, which forms the peripheral areas of the radiating plane by circulating almost round the rectangle represented by the radiating plane. It has a first portion that consists of that end of the radiating plane that is closest to the first short-circuit point, a second portion that consists of the opposite long side of the radiating plane as viewed from the feed point and the first short-circuit point, a third portion that consists of the other end of the radiating plane, and a fourth portion that extends, in the direction of the long side, towards the feed point and the first short-circuit point. The upper operating band of the PIFA is based on the second conductor branch 222. After the common first portion of the conductor branches it forms a straight strip in the direction of the long side of the rectangle, which is separated from the second portion of the first conductor branch only by a relatively narrow slot. Between the second conductor branch and the third and the fourth portion of the first conductor branch there remains a relatively wide inner area 229. It opens to the edge of the radiating plane between the free end of the first conductor branch and the feed point FP.

The antenna structure also includes a parasitic element 230. This is a planar conductive strip on the same geometric plane as the radiating plane 220. The substantial feature is that the parasitic element is located in the above mentioned inner area between the first and the second conductor branch of the radiating plane. One end of the parasitic element is connected to the ground with the second short-circuit conductor 235, which is on the same long side of the antenna as the feed conductor 226 and the first short-circuit conductor 225. The connecting point of the second short-circuit conductor in the parasitic element is called the second short-circuit point S2. The feed point, the first and the second short-circuit point are in a row relatively close to each other so that the feed point is in the middle. Starting from the second short-circuit point, the parasitic element 230 has a first portion, which is separated from the radiating plane 220 only by a narrow slot. This means that there is a relatively strong, predominantly inductive coupling over the slot, which makes it possible for the parasitic element to function as an auxiliary radiator and is, on the other hand, advantageous for the matching of the PIFA on the lower operating band. After the first portion, the parasitic element of the example has a longitudinal central portion and then the end portion, which is directed towards the corner formed by the third and the fourth portion of the first conductor branch 221 of the radiating plane. Between the end portion of the parasitic element and the first conductor branch 221 there is a significant, predominantly capacitive coupling, which contributes to the function of the parasitic element as an antenna element. In addition, this coupling also means increasing the electric length of the first conductor branch, with the result that the size of the PIFA is decreased. Furthermore, directing the free end of the parasitic element towards the first conductor branch means that the coupling between the parasitic element and the second conductor branch corresponding to the upper resonance of the PIFA can be kept relatively weak in spite of the fact that the parasitic element is located "within" the radiating plane. This makes it possible to tune the frequencies of the resonance determined by the parasitic element and the upper resonance of the PIFA relatively independently of each other.

FIG. 2 shows a bit of the edge frame 250 supporting the radiating plane. Naturally, a larger amount of dielectric support structure is included in the whole structure so that all the antenna elements remain accurately in place. In this example, the antenna feed conductor and the first short-circuit conductor are of the same metal sheet with the radiating plane, and correspondingly the second short-circuit conductor is of the same sheet with the parasitic element. At the same time, the conductors function as springs and their lower ends press towards the circuit board 101 by spring force in the installed antenna.

Figure 3:
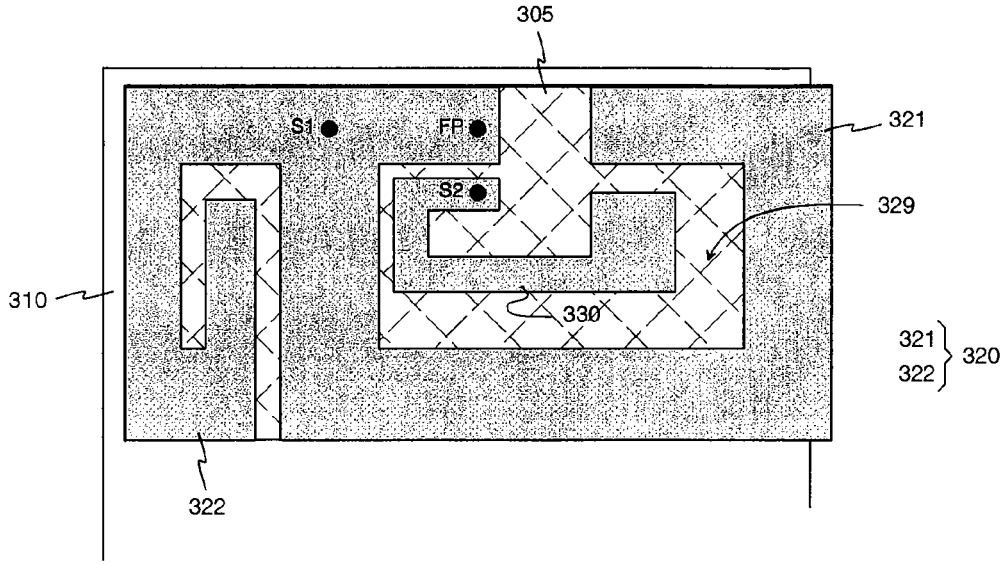
FIG. 3 shows another example of an internal multiband antenna according to the invention.

FIG. 3 shows another example of an internal multiband antenna according to the invention. The antenna is depicted from above, i.e. above the radiating plane. The radiating parts are now conductive areas on the upper surface of a rectangular dielectric plate 305. The ground plane 310 is seen a little below the dielectric plate 305. On the radiating plane 320 there is the antenna feed point FP and the first short-circuit point S1 close to a long side of the plate 305. The radiating plane has two branches in this example, too.

The first conductor branch 321 starts from the first short-circuit point S1 transversely across the plate 305, continues along the opposite long side of the plate, then along the second end and along the first mentioned long side to a point close to the feed point FP. In the centre of an enclosure formed by the first conductor branch there remains a relatively wide inner area 329, which opens to the edge of the plate between the free end of the first conductor branch and the feeding point. The second conductor branch 322 is located beside the first branch at the first end of the dielectric plate 305 so that the free end of the branch is surrounded by conductor areas on the surface plane.

The parasitic element 330 is located entirely in the inner area 329. It is connected to the ground plane at its first end at the second short-circuit point S2. The second short-circuit point is located close to the feeding point FP towards the middle area of the plate from it. Starting from the first end, the parasitic element has a first portion, which is separated from the radiating plane 320 only by a narrow slot. In the first portion there is first a longitudinal part and then a transversal part directed across the plate. After the first portion, the parasitic element has a longitudinal middle portion and an end portion extending towards the free end of the first conductor branch 321 in a transverse direction.

Figure 4:
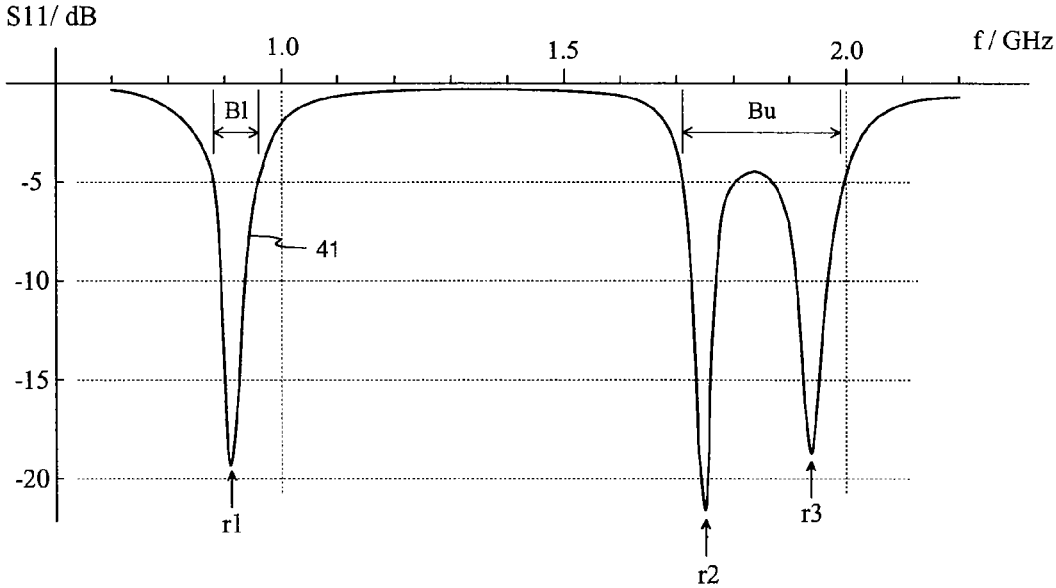
FIG. 4 shows an example of the frequency characteristics of an antenna according to the invention.

FIG. 4 shows an example of the frequency characteristics of an antenna like the one shown in FIG. 2. The figure shows a graph 41 of the reflection coefficient S11 as a function of frequency. The measured antenna has been designed to operate in the GSM900, GSM1800 and GSM1900 systems. The band required by the first system is located in the frequency range 880-960 MHz, which is the lower operating band B/ of the antenna. The bands required by the two latter systems are located in the frequency range 1710-1990 MHz, which is the upper operating band Bu of the antenna. It can be seen from the graph that on the edges of the lower operating band the reflection coefficient of the antenna is approximately −5 dB and naturally better between them. On the upper operating band, the reflection coefficient of the antenna varies between the values −4.4 dB and −22 dB. The three significant resonances of the antenna can be seen from the shape of the graph 41. The entire lower operating band B/ is based on the first resonance r1, which is on the structure formed by the first conductor branch of the radiating plane together with the other conductors of the antenna. The upper operating band Bu is based on the second resonance r2 and the third resonance r3. The second resonance has a frequency of approx. 1.75 GHz, and it occurs on a structure formed by the parasitic element according to the invention together with the other conductors of the antenna. The third resonance has a frequency of approx. 1.94 GHz, and it occurs on a structure formed by the second conductor branch of the radiating plane together with the other conductors of the antenna. All three resonances are remarkably strong; the peak values of the reflection coefficient are around −20 dB.

Figure 5:
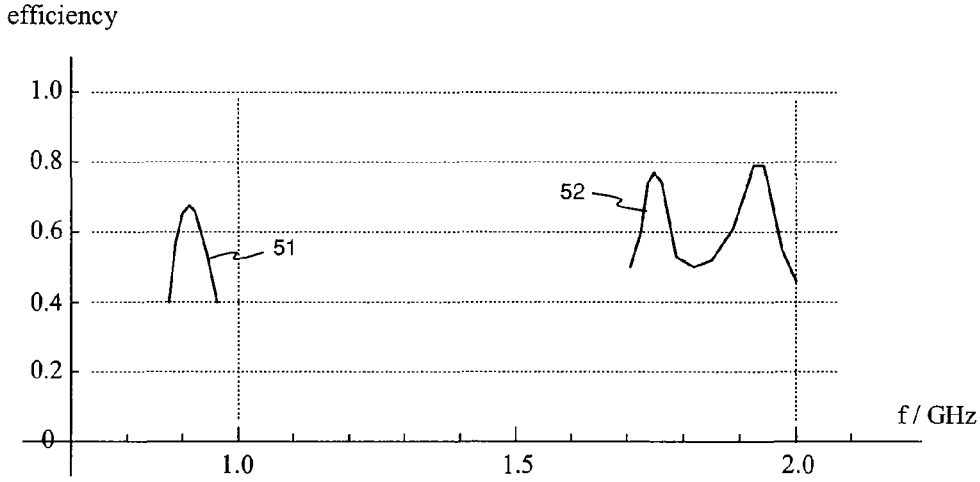
FIG. 5 shows an example of the efficiency of an antenna according to the invention.

FIG. 5 shows an example of the efficiency of an antenna according to the invention. The efficiencies have been measured from the same structure as the matching graphs of FIG. 4. Graph 51 shows how the efficiency changes on the lower operating band and graph 52 shows the same on the upper operating band. On the lower operating band the efficiency varies between 0.4 and 0.7, and on the upper operating band between 0.5 and 0.8. The values are remarkably high for an antenna of that type.

The antenna gain, or the relative field strength measured in the most advantageous direction in a free space, varies on the lower operating band between 0 and 2 dB and on the upper operating band between 1 and 3.5 dB.

Figure 6:
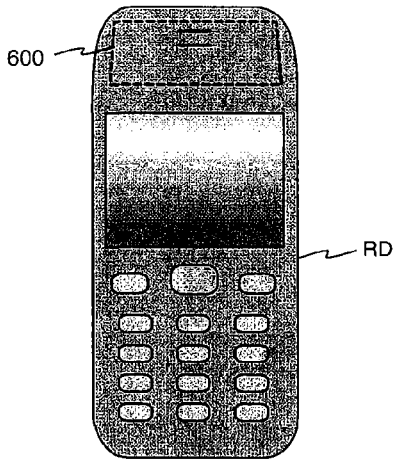
FIG. 6 shows an example of a radio device according to the invention.

FIG. 6 shows an example of a radio device according to the invention. The radio device RD has an internal multiband antenna 600 according to the above description, marked with a dashed line in the figure.

In this description and the claims, the qualifier "close" means a distance which is relatively small compared to the width of the planar antenna, in the order of less than a tenth of the wavelength that corresponds to the highest usable resonance frequency of the antenna.

In this description, "outline" means a line circling round a planar piece along its outer edges. The outline does not include the inner edge of a planar piece, i.e. it skips over the meanders that the edge line makes inward from the outer edge.

In this description and the claims, the "inner area" of a planar piece means an area confined by the above mentioned inner edge and the part of the outline of the planar piece that connects the outermost points of the inner edge.

Multiband antennas according to the invention have been described above. The shapes of the antenna elements can naturally differ from those described. For example, in the PIFA part of the antenna there can also be a slot radiator with its own resonances. The invention does not limit the manufacturing way of the antenna. The antenna elements can be made of sheet metal, metal foil or some conductive coating. The inventive idea can be applied in different ways within the scope defined by the independent claims 1 and 9.

The invention claimed is:

1. An internal multiband antenna of a radio device, which antenna has at least a first and a second operating band and comprises a ground plane, a radiating plane and a radiating parasitic element electromagnetically coupled to the radiating plane, which radiating plane is at a feeding point connected to antenna port of the radio device and at a first short-circuit point to the ground plane, and is divided into a first and a second conductor branch as viewed from the first short-circuit point, and which parasitic element is at a second short-circuit point connected to the ground plane, wherein the first conductor branch together with the surrounding antenna parts forms a resonator having a natural frequency in said first operating band the second conductor branch together with the surrounding antenna parts forms a resonator having a natural frequency in said second operating band, and the parasitic element together with the surrounding antenna parts forms a resonator having a natural frequency in some operating band of the antenna, said feed point being close to the second short-circuit point, and the parasitic element being located substantially on the same geometric plane as the radiating plane, in its inner area.

2. A multiband antenna according to claim 1, the electromagnetic coupling between the radiating plane and the parasitic element being for the most part caused by a predominantly inductive coupling between a first portion of the parasitic element, as viewed from the second short-circuit point, and the radiating plane.

3. A multiband antenna according to claim 1, the electromagnetic coupling between the radiating plane and the parasitic element being for the significant part caused by a predominantly capacitive coupling between opposite end of the parasitic element as viewed from the second short-circuit point, and the electrically most distant portion of the first conductor branch as viewed from the first short-circuit point, in order to reduce the significance of coupling between the parasitic element and the second conductor branch.

4. A multiband antenna according to claim 1, wherein the second operating band of the antenna is its upper operating band, and the natural frequency of the resonator based on the parasitic element is in said upper operating band to widen it.

5. A multiband antenna according to claim 1, which further has a third operating band, the natural frequency of the resonator based on a parasitic element being in said third operating band.

6. A multiband antenna according to claim 1, the radiating plane and the parasitic element being separate pieces of sheet metal.

7. A multiband antenna according to claim 1, the radiating plane and the parasitic element being conductive areas on a surface of a dielectric plate.

8. A radio device having at least a first and a second operating band and comprising an internal multiband antenna, which has a ground plane, a radiating plane and a radiating parasitic element electromagnetically coupled to the radiating plane, which radiating plane is at a feed point connected to an antenna port of the radio device and at a first short-circuit point to the ground plane and, as viewed from the first short-circuit point the radiating plane, is divided into a first and a second conductor branch, and which parasitic element is connected to the ground plane at a second short-circuit point, wherein the first conductor branch together with the surrounding antenna parts forms a resonator having a natural frequency in said first operating band the second conductor branch together with the surrounding antenna parts forms a resonator having a natural frequency in said second operating band, and the parasitic element together with the surrounding antenna parts forms a resonator having a natural frequency in some operating band of the antenna, said feed point being close to the second short-circuit point, and the parasitic element being located substantially on the same geometric plane as the radiating plane, in its inner area.

9. An internal multiband antenna of a radio device, which antenna has at least a first and a second operating band and comprises a ground plane, a radiating plane and a radiating parasitic element electromagnetically coupled to the radiating plane, which radiating plane is at a feeding point connected to antenna port of the radio device and at a first short-circuit point to the ground plane, and is divided into a first and a second conductor branch as viewed from the first short-circuit point, and which parasitic element is at a second short-circuit point connected to the ground plane, wherein the first conductor branch together with the surrounding antenna parts forms a resonator having a natural frequency in said first operating band the second conductor branch together with the surrounding antenna parts forms a resonator having a natural frequency in said second operating band, and the parasitic element together with the surrounding antenna parts forms a resonator having a natural frequency in some operating band of the antenna, said feed point being close to the second short-circuit point, and the parasitic element being located substantially on the same geometric plane as the radiating plane, in its inner area, wherein the inner area is confined by both the first and the second conductor branch.

* * * * *